US007074283B2

(12) United States Patent
Omura

(10) Patent No.: US 7,074,283 B2
(45) Date of Patent: Jul. 11, 2006

(54) LOW ALLOY STEEL

(75) Inventor: Tomohiko Omura, Kishiwada (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 208 days.

(21) Appl. No.: 10/717,716

(22) Filed: Nov. 21, 2003

(65) Prior Publication Data

US 2004/0187971 A1 Sep. 30, 2004

Related U.S. Application Data

(63) Continuation of application No. PCT/JP03/03748, filed on Mar. 26, 2003.

(30) Foreign Application Priority Data

Mar. 29, 2002 (JP) ..... 2002-093788

(51) Int. Cl.
*C22C 38/52* (2006.01)
*C21D 8/02* (2006.01)

(52) U.S. Cl. ..... 148/333; 148/540; 420/110

(58) Field of Classification Search ..... 148/333, 148/334, 338, 320, 540; 420/110
See application file for complete search history.

(56) References Cited

U.S. PATENT DOCUMENTS

| | | | | |
|---|---|---|---|---|
| 4,842,816 A | * | 6/1989 | Miyasaka et al. | 420/84 |
| 6,267,828 B1 | | 7/2001 | Kushida et al. | |

FOREIGN PATENT DOCUMENTS

| | | | | |
|---|---|---|---|---|
| EP | 0828007 A1 | | 3/1998 | |
| JP | 357041354 | * | 3/1982 | 420/84 |
| JP | 402290947 | * | 11/1990 | |
| JP | 3-47918 | | 2/1991 | |
| JP | H07-56046 | | 6/1995 | |
| JP | 2000-178682 | | 6/2000 | |
| JP | 2000-297334 | | 10/2000 | |
| JP | 2001-131698 | | 5/2001 | |
| JP | 2001-172739 | | 6/2001 | |

OTHER PUBLICATIONS

Machine-English translation of Japanese patent 2001-172739, Abe Toshiharu, Jun. 6, 2001.*

* cited by examiner

*Primary Examiner*—Scott Kastler
(74) *Attorney, Agent, or Firm*—Clark & Brody

(57) ABSTRACT

A low alloy steel, characterized by consisting of, by mass %, C: 0.2–0.55%, Si: 0.05–0.5%, Mn: 0.1–1%, S: 0.0005–0.01%, O(Oxygen): 0.0010–0.01%, Al: 0.005–0.05%, Ca: 0.0003–0.007%, Ti: 0.005–0.05%, Cr: 0.1–1.5%, Mo: 0.1–1% and Nb: 0.005–0.1%, and the balance Fe and impurities; and also characterized by the impurities whose contents are restricted to P≦0.03% and N≦0.015%; and further characterized by containing composites of inclusions of not greater than 7 μm in major axis with appearance frequency of not less than 10 pieces of composites per 0.1 $mm^2$ of the steel cross section, wherein the composite comprises an outer shell of carbonitride of Ti and/or Nb surrounding a nucleus of oxysulfide of Al and Ca.

The low alloy steel suppresses pitting caused by inclusions and suppresses SSC induced by pitting.

8 Claims, 2 Drawing Sheets

LOW ALLOY STEEL

This application is a continuation of International Patent Application No. PCT/JP03/03748, filed Mar. 26, 2003. This PCT application was not in English as published under PCT Article 21(2).

TECHNICAL FIELD

The present invention relates to a low alloy steel, and more particularly, a low alloy steel with a strong pitting resistance in an acidic environment, which can suppress stress corrosion cracking induced by pitting. It is suitable for use as a material of oil casing and tubing goods for an oil well and a gas well, and also drill pipes, drill collars and sucker rods for digging a well, and furthermore, pipes or tubes for petrochemical plants because it has a strong resistance to pitting and stress corrosion cracking in a severe acidic environment.

The present invention also relates to a manufacturing method of the low alloy steel.

BACKGROUND ART

Nowadays, the tight conditions for energy resources has increased the demand for crude oil and natural gas including a large amount of corrosive gas such as hydrogen sulfide and carbon dioxide, the use of which has so far been intentionally avoided.

Thus, materials to be are required to provide a higher resistance to pitting and stress corrosion cracking, in order to meet the requirement of drilling, transportation and storage in such an acidic environment.

Furthermore, the materials are required to provide a higher strength in order to meet the requirement of deeper drilling, more efficient transportation, and the reduction of drilling cost, even though a high strength steel is more susceptible to sulfide stress cracking. Therefore, higher strength steel is required to provide a higher resistance to sulfide stress cracking.

Hereinafter, we refer to stress corrosion cracking as "SCC", and sulfide stress cracking as "SSC", respectively, in this specification.

The following studies and proposals have been made in order to suppress pitting, SCC and SSC that may occur in a low alloy steel product such as pipes and tubes.

For suppressing pitting and SCC induced by pitting, an attempt was made to make steel without impurities. However, the techniques for minimizing the level of impurity elements and for removing inclusions using such equipment as a tundish heater, have their own limits from both the point of technique and also the cost aspects of steel making.

In order to suppress SSC, steel products have so far been improved by the metallographic method such as (1) making them with less impurities, (2) making their microstructure rich in the martensitic phase, (3) making their microstructure fine-grained, and (4) subjecting them to heat treatment for tempering at high temperatures. However, coarse nonmetallic inclusions in the steel products may cause pitting, which may often induce SSC. Thus, steel products containing coarse nonmetallic inclusions cannot be always satisfied with improvement in the above metallographic method.

Japanese Unexamined Patent Publication No. 2001-131698 pointed out that Ti carbonitride caused pitting and thus induced SSC. Most of the low alloy steel products contain Ti because Ti is often added to make them fine-grained and to increase their strength. The Ti carbonitride itself is insoluble in an acidic environment and has a high corrosion resistance and high electric conductivity. However, when immersed in an aqueous solution, it acts as cathode site to promote the corrosion of the surrounding steel matrix. The Japanese Unexamined Patent Publication pointed out that the susceptibility of pitting greatly depended on the precipitate size of Ti carbonitride, and proposed a method of suppressing pitting by reducing the content of nitrogen and removing inclusions using a tundish heater. However, this proposal is not satisfactory to suppress pitting in spite of the increased cost during steel making.

It is an objective of the present invention, which has been made in view of the above-mentioned state of the art, to provide such a low alloy steel excellent in pitting resistance that can avoid the occurrence of pitting caused by inclusions and also avoid inducing SSC.

Another objective of the present invention is to provide a manufacturing method of the low alloy steel.

DISCLOSURE OF INVENTION

The subject matters of the present invention consist in the following low alloy steel (1) or (2), and a manufacturing method (3) or (4).

A Low Alloy Steel (1)

A low alloy steel, characterized by consisting of, by mass %, C: 0.2–0.55%, Si: 0.05–0.5%, Mn: 0.1–1%, S: 0.0005–0.01%, O(Oxygen): 0.0010–0.01%, Al: 0.005–0.05%, Ca: 0.0003–0.007%, Ti: 0.005–0.05%, Cr: 0.1–1.5%, Mo: 0.1–1% and Nb: 0.005–0.1%, and the balance Fe and impurities; and also characterized by the impurities whose contents are restricted to P≦0.03% and N≦0.015%; and further characterized by containing composites of inclusions of not greater than 7 μm in major axis with an appearance frequency of not less than 10 pieces of composites per 0.1 $mm^2$ of the steel cross section, wherein the composite comprises an outer shell of carbonitride of Ti and/or Nb surrounding a nucleus of oxysulfide of Al and Ca.

It is preferable that S content be 0.0010–0.01%.

A Low Alloy Steel (2)

A low alloy steel, characterized by consisting of, by mass %, C: 0.2–0.55%, Si: 0.05–0.5%, Mn: 0.1–1%, S: 0.0005–0.01%, O(Oxygen): 0.0010–0.01%, Al: 0.005–0.05%, Ca: 0.0003–0.007%, Ti: 0.005–0.05%, Cr: 0.1–1.5%, Mo: 0.1–1% and Nb: 0.005–0.1%, and at least one alloying element selected from V: 0.03–0.5%, B: 0.0001–0.005% and Zr: 0.005–0.10%, and the balance Fe and impurities; and also characterized by the impurities whose contents are restricted to P≦0.03% and N≦0.015%; and further characterized by containing composites of inclusions of not greater than 7 μm in major axis with an appearance frequency of not less than 10 pieces of composites per 0.1 $mm^2$ of the steel cross section, wherein the composite comprises an outer shell of carbonitride of Ti, Nb and/or Zr surrounding a nucleus of oxysulfide of Al and Ca.

It is preferable that S content be 0.0010–0.01%.

A Manufacturing Method (3)

A method of manufacturing a low alloy steel that contains composites of inclusions of not greater than 7 μm in major axis with an appearance frequency of not less than 10 pieces of composites per 0.1 $mm^2$ of the steel cross section, wherein the composite comprises an outer shell of carbonitride of Ti and/or Nb surrounding a nucleus of oxysulfide of Al and Ca, characterized by cooling the steel at a rate of not more than 500° C./min from 1500° C. to 1000° C. during casting the low alloy steel (1) above.

A Manufacturing Method (4)

A method of manufacturing a low alloy steel that contains composites of inclusions of not greater than 7 μm in major axis with an appearance frequency of not less than 10 pieces of composites per 0.1 $mm^2$ of the steel cross section, wherein the composite comprises an outer shell of carbonitride of Ti, Nb and/or Zr surrounding a nucleus of oxysulfide of Al and Ca, characterized by cooling the steel at a rate of not more than 500° C./min from 1500° C. to 1000° C. during casting the low alloy steel (2) above.

In the present specification, the invention concerned with the low alloy steels (1) or (2) above is referred to as "invention (1)" or "invention (2)", respectively, and the invention concerned with the manufacturing method (3) or (4) above as "invention (3)" or "invention (4)", respectively. Sometimes, the inventions (1) to (4) are collectively referred to as "the present invention".

We evaluated the composite of inclusions as follows:

We arbitrarily selected a plurality of fields of view on the cross section of each test specimen. In each field of view, we measured the number and the major axes of the composites observed per unit area, and specified the composite whose major axis was the largest in each field of view, wherein the major axis of composite was defined as the longest distance between two arbitrary points on a boundary of a composite to the matrix.

Then, we calculated an average value of the major axis of the specified composite, by dividing the sum of the value of the major axes by the number of fields of view. As a result, we found the average value of the longest major axes of the composites on the cross section of one test specimen, to which we refer as the value of "the longest major axis" in short hereinafter.

In an attempt to achieve the above objective, the inventor made various investigations concerning the technologies of dispersing inclusions in the fine form that may lead to precipitate a fine composite inclusion. The inventor conceived an idea that consisted preliminarily forming of a nucleus of oxysulfide of Al and Ca and succeeding precipitating of a carbonitride of Ti, Nb and/or Zr around the nucleus. The inventor performed a number of experiments on this idea and obtained the following findings (a) to (c).

(a) The oxysulfide of Al and Ca acts as a nucleus for absorbing Ti, Nb and Zr. Therefore, when oxysulfide of Al and Ca is formed in advance, carbonitride of Ti, Nb and/or Zr can precipitate around the nucleus, resulting in precipitation of a large number of fine composite inclusions, each of which has an outer shell of carbonitride of Ti, Nb and/or Zr surrounding the nucleus of an oxysulfide of Al and Ca.

Hereinafter such a composite inclusion is referred to as "a carbonitride composite inclusion with Al—Ca oxysulfide nucleus".

The precipitation of the carbonitride composite inclusion with Al—Ca oxysulfide nucleus can suppress to precipitate the coarse carbonitride of Ti, Nb and/or Zr surrounding the nucleus of Al oxide or the like, or can lead to precipitate fine carbonitride inclusions not greater than 7 μm in size, even if the carbonitride of Ti, Nb and/or Zr surrounding nucleus of Al oxide precipitates.

(b) The precipitated fine carbonitride composite inclusion with Al—Ca oxysulfide nucleus may not affect the corrosion resistance.

(c) The fine carbonitride composite inclusion with Al—Ca oxysulfide nucleus can be obtained by cooling at the rate of not more than 500° C./min from 1500° C. to 1000° C. during the casting of the low alloy steel (1) or (2) above.

It is necessary that the carbonitride composite inclusion with Al—Ca oxysulfide nucleus has a major axis of, at most, 7 μm.

Based on the above findings of (a) to (c), the inventions (1) to (4) have been completed.

BRIEF DESCRIPTION OF THE INVENTION

BEST MODES FOR CARRYING OUT THE INVENTION

Figure 1:
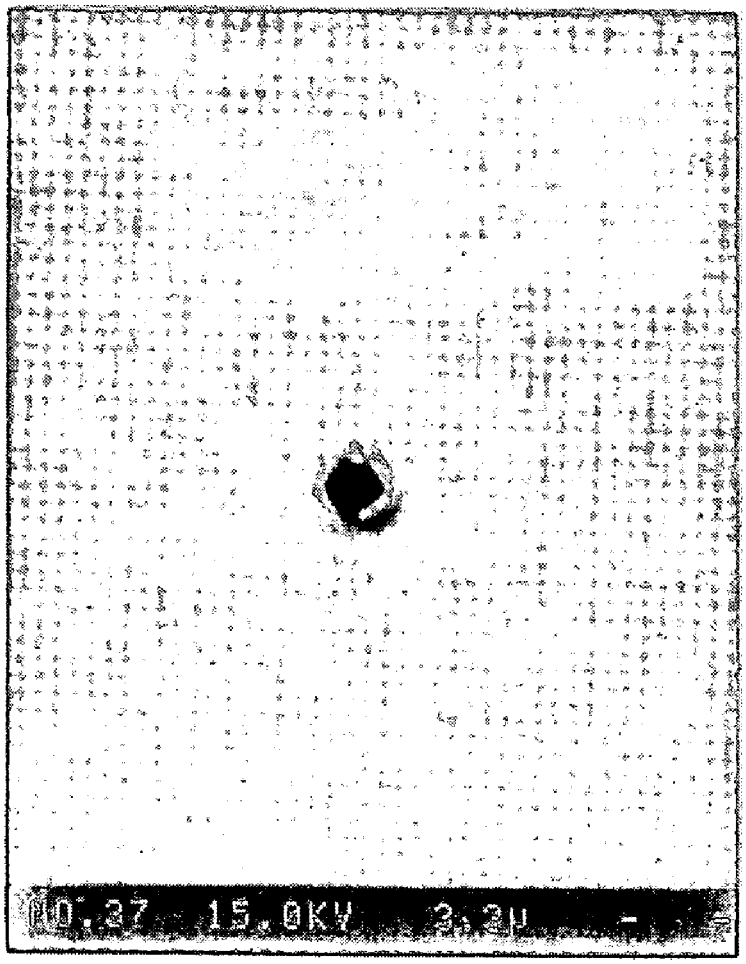
FIG. 1 is representation of a typical example of the carbonitride composite inclusion with Al—Ca oxysulfide nucleus with a major axis of not longer than 7 μm.

In the following, the present invention is described in detail. The expression "%" for the content of each element means "mass %".

(A) Chemical Composition of the Steel

C: 0.2–0.55%

C is an element effective in enhancing hardenability and improving strength, and not less than 0.2% is required. Exceeding 0.55%, however, leads to a high susceptibility of quenching crack and also to a decreased toughness. Therefore, the C content should be 0.2–0.55%.

Si: 0.05–0.5%

Si is an element necessary for deoxidation, and its content of not less than 0.05% is necessary for producing a satisfactory deoxidizing effect. Exceeding 0.5%, however, decreases in toughness and SSC resistance. Therefore, the Si content should be 0.05–0.5%. A preferred content range is 0.05–0.35%.

Mn: 0.1–1%

Mn is an element having an effect of increasing the hardenability of steel and, in order to obtain this effect, a content of not less than 0.1% is necessary. Exceeding 1%, however, enhances the segregation of Mn at grain boundaries, which decreases the toughness and SSC resistance. Therefore, the Mn content should be 0.1–1%. A preferred content range is 0.1–0.5%.

S: 0.0005–0.01%

S, together with Ca, Al and O (oxygen), forms a fine nucleus of oxysulfide of Al and Ca that leads to precipitation of carbonitride of Ti, Nb and/or Zr around the nucleus, which result in precipitating a fine carbonitride composite inclusion with Al—Ca oxysulfide nucleus. This fine composite inclusion has the effect of suppressing the formation of a coarse carbonitride of Ti, Nb and/or Zr. In order to obtain this effect, the S content of not less than 0.0005% is necessary. Exceeding 0.01% of S, however, decreases the resistance to pitting and SSC. Therefore, the S content should be 0.0005–0.01%. A preferred S content is 0.0010–0.01%.

O (oxygen): 0.0010–0.01%

O, together with Ca, Al and S, forms a fine nucleus of oxysulfide of Al and Ca that leads to precipitate carbonitride of Ti, Nb and/or Zr around the nucleus, which result in precipitating a fine carbonitride composite inclusion with Al—Ca oxysulfide nucleus. This fine composite has the effect of suppressing the formation of a coarse carbonitride of Ti, Nb and/or Zr. In order to obtain this effect, O content of not less than 0.0010% is necessary. Exceeding 0.01%, however, decreases the resistance pitting and SSC, therefore, the O content should be 0.0010–0.01%.

Al: 0.005–0.05%

Al is an element necessary for deoxidation of steel and, when its content is below 0.005%, that effect can hardly be obtained. On the other hand, that effect saturates at the content exceeding 0.05%, and, in addition, coarse Al-based oxides are formed abundantly, causing decreases in toughness. Further, Al, together with Ca, S and O, forms a fine nucleus of oxysulfide of Al and Ca that leads to precipitation of carbonitride of Ti, Nb and/or Zr around the nucleus, which result in precipitating a fine carbonitride composite inclusion with Al—Ca oxysulfide nucleus. This fine composite has the effect of suppressing the formation of coarse carbonitride of Ti, Nb and/or Zr, therefore, the Al content should be 0.005–0.05%. The term "Al" as used herein denotes "sol. Al", which means Al soluble in acid.

Ca: 0.0003–0.007%

Ca is an important element in the practice of the present invention. Ca, together with Al, S and O, forms a fine nucleus of oxysulfide of Al and Ca that leads to precipitation of carbonitride of Ti, Nb and/or Zr around the nucleus, which result in precipitating a fine carbonitride composite inclusion with Al—Ca oxysulfide nucleus. And, the fine composite has the effect of suppressing the formation of coarse carbonitride of Ti, Nb and/or Zr. Furthermore, the fine composite improves the resistance to pitting, SCC and SSC. If Ca level is below 0.0003%, however, the effect of the addition is poor. If Ca level is exceeding 0.007%, on the other hand, the oxysulfide of Al and Ca itself becomes coarse, which causes pitting. Therefore, the Ca content should be 0.0003–0.007%.

Ti: 0.005–0.05%

Ti absorbs carbon and nitrogen in steel around a nucleus of oxysulfide of Al and Ca, which result in precipitating a fine carbonitride composite inclusion with Al—Ca oxysulfide nucleus. This is effective in strengthening steel by making the crystal grains fine and by precipitation strengthening. Furthermore, in steel containing boron, Ti is effective in suppressing the formation of boron nitride, which results in promoting the improvement in hardenability owing to B. For obtaining these effects, Ti content of not less than 0.005% is necessary. On the other hand, exceeding 0.05% of Ti forms coarse carbonitride of Ti, Nb and/or Zr, which may cause pitting even if the Ca content is in the range mentioned above. Therefore, the Ti content should be 0.005–0.05%. A preferred content range is 0.005–0.03%.

Cr: 0.1–1.5%

Cr improves the hardenability and also increases the temper softening resistance, thus enabling high-temperature tempering and improving the SSC resistance. These effects can be obtained if the Cr content is not less than 0.1%. However, if the Cr content level exceeds 1.5%, the above effects saturate, and the cost increases. Therefore, the Cr content should be 0.1–1.5%.

Mo: 0.1–1%

Mo improves the hardenability and also increases the temper softening resistance, thus enabling high-temperature tempering and improving the SSC resistance. At content levels below 0.1%, however, no satisfactory effects can be obtained. On the other hand, if the Mo content level exceeds 1%, acicular Mo carbide precipitates during tempering, causing decreases in toughness and SSC resistance. Therefore, the Mo content should be 0.1–1%.

Nb: 0.005–0.1%

Nb absorbs carbon and nitrogen in steel around the nucleus of the oxysulfide of Al and Ca, which result in precipitating a fine carbonitride composite inclusion with Al—Ca oxysulfide nucleus. This is effective in strengthening steel by making crystal grains fine and by precipitation strengthening.

When its content is less than 0.005%, the effect of addition is poor. On the other hand, at content levels exceeding 0.1%, the above effect saturates, and the cost increases. Therefore, the Nb content should be 0.05–0.1%.

The contents of the impurity elements P and N are restricted as mentioned below.

P: not more than 0.03%

P inevitably exists as an impurity in steel. It is actively dissolved and thus reduces the pitting resistance. It also segregates at grain boundaries, causing decreases in toughness and SSC resistance. In particular when its content exceeds 0.03%, it decreases in toughness and resistance to pitting and SSC . Therefore, the P content should be not more than 0.03%. It is desirable that the P content be as low as possible.

N: not more than 0.015%

N is an element inevitably existing as an impurity in steel. If N exceeds 0.015%, it will not lead to precipitation of a fine carbonitride composite inclusion with Al—Ca oxysulfide nucleus, but will lead to precipitation of a coarse carbonitride of Ti, Nb and/or Zr that may cause pitting. Therefore, the N content should be not more than 0.015%. It is desirable that the N content be as low as possible.

A low alloy steel according to the invention (1), satisfies the above-mentioned chemical composition. A low alloy steel according to the invention (2), satisfies one or more elements selected from the elements among V, B and Zr, mentioned below, in addition to the above-mentioned chemical composition. V, B or Zr contributes to the improvement in the strength of steel.

V: 0.03–0.5%

V could be added. If added, however, it precipitates a fine carbide during tempering and thus increases the temper softening resistance, whereby tempering at high temperatures becomes possible and the SSC resistance is improved. For ensuring this effect, the V content is desirably not lower than 0.03%. On the other hand, if its content level exceeds 0.5%, the above effect saturates, and the cost increases. Therefore, when added, the V content is recommendably 0.03–0.5%.

B: 0.0001–0.005%

B could be added. When added, however, it is effective, even in trace amounts, in improving the hardenability of the steel. For ensuring this effect, the B content is preferably not lower than 0.0001%. On the other hand, exceeding 0.005% of B leads to precipitation of a coarse carboboride along the grain boundaries, causing decreases in toughness and SSC resistance. Therefore, when added, the B content is recommendably 0.001–0.005%, more preferably 0.0001–0.003%.

Zr: 0.005–0.10%

Zr could be added. When added, however, it absorbs carbon and nitrogen in steel around the nucleus of oxysulfide of Al and Ca that leads to precipitation of carbonitride of Ti, Nb and/or Zr around the nucleus, which result in precipitating a fine carbonitride composite inclusion with Al—Ca oxysulfide nucleus. Also, it is effective in increasing the strength by making crystal grains finer and by precipitation strengthening and, further, in promoting the improvement of the hardenability owning to B. For ensuring these effects, the Zr content is preferably not less than 0.005%. On the other hand, exceeding 0.10% of Zr forms a coarse carbonitride of Ti, Nb and/or Zr, which may cause pitting, even if the Ca content is in the range mentioned above. Therefore, when added, the Zr content is recommendably 0.005–0.10%.

(B) Carbonitride Composite Inclusion with Al—Ca Oxysulfide Nucleus in Steel

The carbonitride composite inclusion with Al—Ca oxysulfide nucleus in the low alloy steel according to the invention, has an outer shell of carbonitride of Ti, Nb and/or Zr surrounding a nucleus of an oxysulfide of Al and Ca. It is necessary that the carbonitride composite is not greater than 7 μm in the major axis with an appearance frequency of not less than 10 pieces of composites per 0.1 $mm^2$ of the steel cross section.

The oxysulfide of Al and Ca may contain oxysulfides of other elements besides Al and Ca, amounting to less than 50% of the total. The carbonitride of Ti, Nb and/or Zr carbonitride may contain carbonitrides of other elements besides Ti, Nb and Zr, amounting to less than 50% of the total.

The oxide of Al readily aggregates and becomes coarse, hence it is ineffective in producing fine dispersions. Therefore, it does lead to a coarse carbonitride of Ti, Nb and/or Zr. To the contrary, the oxysulfides of Al and Ca hardly aggregate, hence it is effective in producing fine dispersions. Therefore, it can be a nucleus to form a carbonitride of Ti, Nb and/or Zr, which leads to precipitation of a finely dispersed carbonitride of Ti, Nb and/or Zr, surrounding the nucleus.

Further, Ca is stronger in oxysulfide formation ability than Al and, therefore, oxysulfide of Al and Ca is formed prior to the formation of oxide of Al. Thus, a fine carbonitride composite inclusion with Al—Ca oxysulfide nucleus having an outer shell of carbonitride of Ti, Nb and/or Zr, surrounding a nucleus of the oxysulfide of Al and Ca, suppresses forming a coarse carbonitride of Ti, Nb and/or Zr surrounding a nucleus of the oxide of Al. The pitting resistance is improved accordingly.

However, if the carbonitride composite inclusion with Al—Ca oxysulfide nucleus itself is coarse, it causes pitting as well as the coarse carbonitride of Ti, Nb and/or Zr. In particular when major axis exceeds 7 μm, the decrease in pitting resistance is remarkable. Therefore, the maximum major axis in the carbonitride composite inclusion with Al—Ca oxysulfide nucleus must be not more than 7 μm.

On the other hand, if the number of such composites is less than 10 per 0.1 $mm^2$, the nucleus of oxysulfide of Al and Ca cannot absorb the Ti, Nb and/or Zr in the steel to a sufficient extent, even if the A carbonitride composite inclusion with Al—Ca oxysulfide nucleus is not greater than 7 μm in major axis. The unabsorbed portion of Ti, Nb and/or Zr forms a coarse carbonitride of Ti, Nb and/or Zr, surrounding a nucleus of oxide of Al , so that the pitting resistance decreases. Therefore, the steel of the present invention should contain 10 or more pieces of the carbonitride composite inclusion with Al—Ca oxysulfide nucleus per 0.1 $mm^2$.

In evaluating these inclusions, we arbitrarily selected 5 fields of view on the cross section of each test specimen. In each field of view, we measured the number and the major axes of the composites observed per 0.1 $mm^2$, and specified the composite whose major axis was the largest in each field of view, wherein the major axis of composite was defined as the longest distance between two arbitrary points on a boundary of a composite to the matrix.

Then, we calculated the average value of the major axis of the specified composite, by dividing the sum of the value of the major axes by 5 which is the number of fields of view. As a result, we found the value of "the longest major axis", that is, the average value of the longest major axes of the composites on the cross section of one test specimen.

The low alloy steel according to the invention (1) or (2), satisfied the above-mentioned requirements for the carbonitride composite inclusion with Al—Ca oxysulfide nucleus. It is also necessary to cool at the rate of not more than 500° C./minute, from 1500° C to 1000° C. during casting, in order to ensure a sufficient time to allow the oxysulfides of Al and Ca to absorb Ti, Nb and Zr.

EXAMPLES

Fourteen kinds of the low alloy steel, having the respective chemical compositions specified in Table 1, were melted.

Each steel species (150 tons) was continuously cast into round billets having a diameter of 220 mm. On that occasion, the cooling rate, in the range from 1500–1000° C., was varied, as shown in Table 2, by controlling the amount of cooling water for the mold and for cooling billets during the casting from 1500° C. to 1000° C.

Then, the round billets of steel H and steel I were each reheated to 1250° C. and then subjected to hot forging and hot rolling by the conventional methods to produce 15-mm-thick plates.

The round billets of steel A, steel C and steels J to M were each reheated to 1250° C. and then subjected to hot rolling by the conventional method to produce round bars with a diameter of 40 mm.

The round billets of steel B, steels D to G and steel N were each reheated to 1250° C. and then subjected to hot rolling by the conventional method to produce seamless pipes with a wall thickness of 10 mm.

TABLE 1

| | chemical composition (unit: mass %, balance: Fe and impurities) | | | | | | | | | | | | | | | |
|---|---|---|---|---|---|---|---|---|---|---|---|---|---|---|---|---|
| Steel | C | Si | Mn | P | S | Al | Ca | Ti | Cr | Mo | Nb | V | B | Zr | N | O |
| A | 0.27 | 0.28 | 0.32 | 0.0021 | 0.0018 | 0.030 | 0.0012 | 0.014 | 1.02 | 0.71 | 0.010 | — | — | — | 0.0051 | 0.0033 |
| B | 0.23 | 0.30 | 0.11 | 0.0025 | 0.0013 | 0.032 | 0.0011 | 0.015 | 0.58 | 0.31 | 0.011 | — | — | — | 0.0042 | 0.0031 |
| C | 0.45 | 0.11 | 0.22 | 0.0028 | 0.0012 | 0.030 | 0.0004 | 0.021 | 1.21 | 0.68 | 0.035 | 0.24 | — | — | 0.0141 | 0.0050 |
| D | 0.23 | 0.31 | 0.41 | 0.0020 | 0.0011 | 0.028 | 0.0028 | 0.044 | 1.01 | 0.53 | 0.032 | — | 0.0011 | — | 0.0043 | 0.0028 |
| E | 0.35 | 0.29 | 0.40 | 0.0018 | 0.0021 | 0.030 | 0.0024 | 0.009 | 0.49 | 0.33 | 0.011 | — | — | 0.020 | 0.0039 | 0.0020 |
| F | 0.40 | 0.31 | 0.29 | 0.0031 | 0.0009 | 0.031 | 0.0065 | 0.016 | 1.02 | 0.76 | 0.032 | 0.21 | — | — | 0.0081 | 0.0030 |

TABLE 1-continued

| Steel | C | Si | Mn | P | S | Al | Ca | Ti | Cr | Mo | Nb | V | B | Zr | N | O |
|---|---|---|---|---|---|---|---|---|---|---|---|---|---|---|---|---|
| | chemical composition (unit: mass %, balance: Fe and impurities) | | | | | | | | | | | | | | | |
| G | 0.28 | 0.29 | 0.21 | 0.0022 | 0.0015 | 0.032 | 0.0049 | 0.015 | 0.51 | 0.73 | 0.011 | 0.10 | 0.0012 | — | 0.0041 | 0.0029 |
| H | 0.28 | 0.27 | 0.33 | 0.0023 | 0.0022 | 0.027 | 0.0015 | 0.016 | 1.01 | 0.69 | 0.005 | — | — | — | 0.0045 | 0.0026 |
| I | 0.27 | 0.30 | 0.45 | 0.0030 | 0.0011 | 0.031 | 0.0051 | 0.015 | 0.98 | 0.71 | 0.029 | — | 0.0013 | — | 0.0040 | 0.0043 |
| J | 0.29 | 0.25 | 0.44 | 0.0030 | 0.0030 | 0.036 | *0.0002 | 0.015 | 0.98 | 0.72 | 0.025 | — | — | — | 0.0056 | 0.0031 |
| K | 0.27 | 0.23 | 0.44 | 0.0041 | 0.0054 | 0.029 | *0.0079 | 0.018 | 1.04 | 0.71 | 0.031 | — | — | — | 0.0042 | 0.0027 |
| L | 0.26 | 0.29 | 0.41 | 0.0031 | 0.0022 | 0.028 | 0.0015 | *0.058 | 1.01 | 0.70 | 0.028 | — | — | — | 0.0048 | 0.0030 |
| M | 0.27 | 0.26 | 0.45 | 0.0050 | 0.0021 | 0.035 | 0.0016 | 0.019 | 1.25 | 0.74 | 0.035 | — | — | — | *0.0181 | 0.0046 |
| N | 0.29 | 0.31 | 0.42 | 0.0020 | 0.0005 | 0.029 | 0.0012 | 0.013 | 1.02 | 0.73 | 0.006 | — | — | — | 0.0051 | 0.0031 |

Note:
*shows out of scope of the present invention.

TABLE 2

| specimen No. | Steel | carbonitride composite inclusion with Al—Ca oxysulfide nucleus: the longest major axis (μm) | carbonitride composite inclusion with Al—Ca oxysulfide nucleus: number of composites per 0.1 mm$^2$ | other carbo-nitrides: the longest major axis (μm) | whether pitting occurred or not. | cooling rate from 1500° C. to 1000° C. (° C./min) |
|---|---|---|---|---|---|---|
| 1 | A | 3.3 | 19 | 4.5 | not occurred | 250 |
| 2 | B | 3.4 | 20 | 4.3 | not occurred | 100 |
| 3 | C | 5.1 | 15 | 5.0 | not occurred | 200 |
| 4 | D | 3.8 | 21 | 6.7 | not occurred | 20 |
| 5 | E | 3.5 | 18 | 5.4 | not occurred | 10 |
| 6 | F | 6.6 | 38 | 4.3 | not occurred | 5.6 |
| 7 | G | 4.2 | 41 | 6.5 | not occurred | 50 |
| 8 | H | 3.2 | *1 | 10.3 | occurred | *1000 |
| 9 | I | 3.1 | *6 | 11.5 | occurred | *1200 |
| 10 | *J | 30.2 | *4 | 15.8 | occurred | 215 |
| 11 | *K | 25.3 | 11 | 13.4 | occurred | 250 |
| 12 | *L | 3.5 | 29 | 12.1 | occurred | 300 |
| 13 | *M | 4.0 | 31 | 11.8 | occurred | 250 |
| 14 | N | 4.5 | 23 | 5.5 | not occurred | 50 |

Note:
*shows out of scope of the present invention.

Test specimens, 10 mm in thickness, 10 mm in width and 10 mm in length, were cut out from the thus-obtained plates, round bars and steel pipes. They were embedded in a resin to reveal the cross sections cut perpendicularly in the direction of hot rolling as test faces, and the test faces were mirror-polished and examined for inclusions by scanning electron microscopy at a magnification of 200. Thus, each test face was observed in the 5 fields of view under a scanning electron microscope at a magnification of 200. Then, the number, observed per 0.1 mm$^2$ in each field, of the composite inclusion with Al—Ca oxysulfide nucleus whose major axis was not more than 7 μm, was counted and averaged in 5 fields. In addition, the values of "the longest major axis", i.e., the average of the longest values in each field of major axes of the composite inclusion with Al—Ca oxysulfide nucleus and the other carbonitrides were also measured. The composite inclusion with Al—Ca oxysulfide nucleus was analyzed to determine its composition, using an EDX (energy dispersion type X-ray microanalyzer).

A typical example of the carbonitride composite inclusion with Al—Ca oxysulfide nucleus, with a major axis of not longer than 7 μm, is shown in FIG. 1. The black nucleus portion consists of the oxysulfide of Al and Ca, and the white outer shell portion consists of carbonitride of Ti, Nb and/or Zr.

Figure 2:
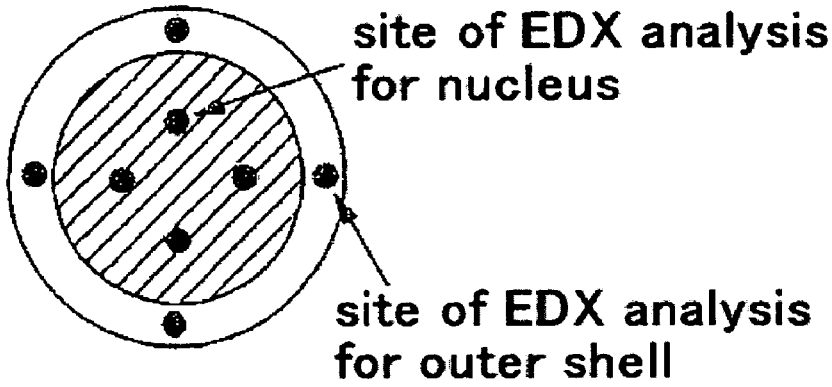
FIG. 2 is a schematic representation of sites of EDX analysis of a carbonitride composite inclusion with Al—Ca oxysulfide nucleus having a major axis of not longer than 7 μm.

FIG. 2 is a schematic illustration of the sites of the EDX analysis of one of the carbonitride composite inclusion with Al—Ca oxysulfide nucleus. The EDX analysis was carried out at 8 sites, in total, as shown in the figure.

The results of the examination of inclusions are shown in Table 2, together with the rates of cooling between 1500–1000° C.

Then, 3-mm-thick, 10-mm-wide and 40-mm-long corrosion test specimens were cut out from the above plates, round bars and steel pipes, were polished with a #600 emery paper, and were immersed in a degassed aqueous solution containing 0.5% acetic acid and 5% sodium chloride at 25° C. for 100 hours, and were then checked to determine whether pitting occurred or not. The results of this investigation are also shown in Table 2.

Table 2 also shows that test numbers 1 to 7 and 14, meet the requirements prescribed in the present invention, and also no pitting was observed, hence the corresponding steels also have good pitting resistance. On the contrary, in test numbers 8 to 13, pitting was observed caused by the coarse carbonitride of Ti, Nb and/or Zr.

Industrial Applicability

The low alloy steel of the invention suppresses pitting caused by inclusions and suppresses SSC induced by pitting. Therefore, it can be used as a material of oil casing and tubing goods for an oil well and gas well, and also drill pipes, drill collars and sucker rods for digging a well, and further, pipes or tubes for petrochemical plants.

The invention claimed is:

1. A low alloy steel, characterized by consisting of, by mass %, C: 0.2–0.55%, Si: 0.05–0.5%, Mn: 0.1–1%, S: 0.0005–0.01%, O(Oxygen): 0.0010–0.01%, Al: 0.005–0.05%, Ca: 0.0003–0.007%, Ti: 0.005–0.05%, Cr: 0.1–1.5%, Mo: 0.1–1% and Nb: 0.005–0.1%, and the balance Fe and impurities; and also characterized by the impurities whose contents are restricted to P≦0.03% and N≦0.015%; and further characterized by containing composites of inclusions of not greater than 7 μm in major axis with an appearance frequency of not less than 10 pieces of composites per 0.1 $mm^2$ of the steel cross section, wherein the composite comprises an outer shell of carbonitride of Ti and/or Nb surrounding a nucleus of oxysulfide of Al and Ca.

2. A low alloy steel, characterized by consisting of, by mass %, C: 0.2–0.55%, Si: 0.05–0.5%, Mn: 0.1–1%, S: 0.0005–0.01%, O(Oxygen): 0.0010–0.01%, Al: 0.005–0.05%, Ca: 0.0003–0.007%, Ti: 0.005–0.05%, Cr: 0.1–1.5%, Mo: 0.1–1% and Nb: 0.005–0.1%, and at least one alloying element selected from V: 0–0.5%, and Zr: 0–0.10%, and the balance Fe and impurities; and also characterized by the impurities whose contents are restricted to P≦0.03% and N≦0.015%; and further characterized by containing composites of inclusions of not greater than 7 μm in major axis with an appearance frequency of not less than 10 pieces of composites per 0.1 $mm^2$ of the steel cross section, wherein the composite comprises an outer shell of carbonitride of Ti, Nb and/or Zr surrounding a nucleus of oxysulfide of Al and Ca.

3. A low alloy steel according to claim 1, characterized by an S content of 0.0010–0.01%.

4. A method of manufacturing a low alloy steel that contains composites of inclusions of not greater than 7 μm in major axis with an appearance frequency of not less than 10 pieces of composites per 0.1 $mm^2$ of the steel cross section, wherein the composite comprises an outer shell of carbonitride of Ti and/or Nb surrounding a nucleus of oxysulfide of Al and Ca according to claim 1, characterized by cooling the steel at a rate of not more than 500° C./min from 1500° C. to 100° C. during the casting of the steel.

5. A method of manufacturing a low alloy steel that contains composites of inclusions of not greater than 7 μm in major axis with appearance frequency of not less than 10 pieces of composites per 0.1 $mm^2$ of the steel cross section, wherein the composite comprises an outer shell of carbonitride of Ti, Nb and/or Zr surrounding a nucleus of oxysulfide of Al and Ca according to claim 2, characterized by cooling the steel at a rate of not more than 500° C./min from 1500° C. to 1000° C. during the casting of the steel.

6. A low alloy steel according to claim 2, characterized by an S content of 0.0010–0.01%.

7. A method of manufacturing a low alloy steel that contains composites of inclusions of not greater than 7 μm in major axis with an appearance frequency of not less than 10 pieces of composites per 0.1 $mm^2$ of the steel cross section, wherein the composite comprises an outer shell of carbonitride of Ti and/or Nb surrounding a nucleus of oxysulfide of Al and Ca according to claim 3, characterized by cooling the steel at a rate of not more than 500° C./min from 1500° C. to 1000° C. during the casting of the steel.

8. A method of manufacturing a low alloy steel that contains composites of inclusions of not greater than 7 μm in major axis with appearance frequency of not less than 10 pieces of composites per 0.1 $mm^2$ of the steel cross section, wherein the composite comprises an outer shell of carbonitride of Ti, Nb and/or Zr surrounding a nucleus of oxysulfide of Al and Ca according to claim 6, characterized by cooling the steel at a rate of not more than 500° C./min from 1500° C. to 1000° C. during the casting of steel.

* * * * *

UNITED STATES PATENT AND TRADEMARK OFFICE

CERTIFICATE OF CORRECTION

PATENT NO. : 7,074,283 B2
APPLICATION NO. : 10/717716
DATED : July 11, 2006
INVENTOR(S) : Tomohiko Omura It is certified that error appears in the above-identified patent and that said Letters Patent is hereby corrected as shown below:

Column 12, line 5:
"from 1500°C to 100°C during the casting of the steel." should read:
--from 1500°C to 1000°C during the casting of the steel.--

Signed and Sealed this

Third Day of April, 2007

JON W. DUDAS
*Director of the United States Patent and Trademark Office*